US006668469B2

(12) United States Patent
Kahl et al.

(10) Patent No.: US 6,668,469 B2
(45) Date of Patent: Dec. 30, 2003

(54) REMOVAL DEVICE

(75) Inventors: Peter Kahl, Gerstetten (DE); Markus Oechsle, Bartholomae (DE); Karl Josef Böck, Heidenheim (DE); Thomas Augscheller, Bachhagel (DE); Stefan Dette, Mainz (DE)

(73) Assignee: Voith Paper Patent GmbH, Heidenheim (DE)

( * ) Notice: Subject to any disclaimer, the term of this patent is extended or adjusted under 35 U.S.C. 154(b) by 310 days.

(21) Appl. No.: 09/820,711

(22) Filed: Mar. 30, 2001

(65) Prior Publication Data

US 2001/0045025 A1 Nov. 29, 2001

(30) Foreign Application Priority Data

Apr. 1, 2000 (DE) ..... 100 16 492

(51) Int. Cl.[7] ..... F26B 3/00

(52) U.S. Cl. ..... 34/454; 34/456; 34/457; 34/458

(58) Field of Search ..... 34/454, 456, 457, 34/458, 116, 117; 162/310, 358.1, 359.1

(56) References Cited

U.S. PATENT DOCUMENTS 4,441,263 A * 4/1984 Vedenpaa ..... 34/115
4,648,942 A 3/1987 Wanke et al.
4,953,297 A 9/1990 Eskelinen et al.
5,515,619 A 5/1996 Kahl et al.
5,600,897 A 2/1997 Sollinger et al.
5,718,058 A 2/1998 Atzinger
5,735,060 A 4/1998 Atzinger et al.
6,076,280 A * 6/2000 Oechsle et al. ..... 34/456

FOREIGN PATENT DOCUMENTS

DE 3328162 2/1986
DE 3790947 5/1989

* cited by examiner

*Primary Examiner*—Jiping Lu
(74) *Attorney, Agent, or Firm*—Greenblum & Bernstein, P.L.C.

(57) ABSTRACT

Device and process for removing a fibrous material web from a drying section of a machine for producing and/or refining the fibrous material web and into a catch device. The drying section includes heated drying cylinders, guidance rolls, and at least one drying wire arranged such that the fibrous material web is guided through the drying section over the heated drying cylinders and the guidance rolls at least predominately by the at least one drying wire. The device includes at least one controllable separating device arranged to at least reduce an adhesion force between the fibrous material web and the at least one drying wire.

38 Claims, 1 Drawing Sheet

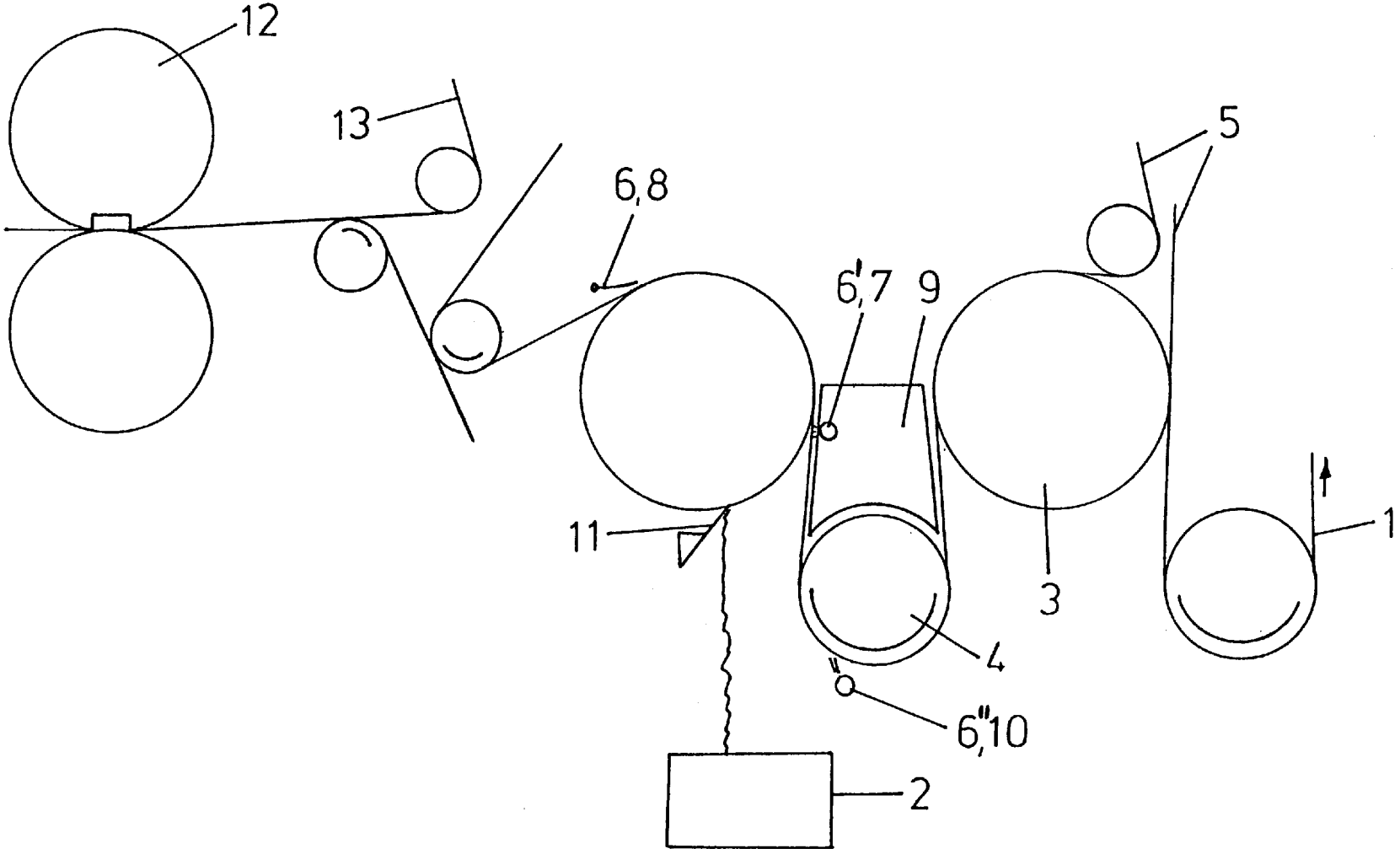
1
5
3
4
6'',10
9
6',7
2
6,8
11
13
12

REMOVAL DEVICE

CROSS-REFERENCE TO RELATED APPLICATIONS

The present application claims priority under 35 U.S.C. § 119 of German Patent Application No. 100 16 492.7, filed on Apr. 1, 2000, the disclosure of which is expressly incorporated by reference herein in its entirety.

BACKGROUND OF THE INVENTION

1. Field of the Invention

The present invention relates to a device and an associated process for removing a fibrous material web, e.g., a cardboard, paper, or tissue web, from a drying section of a machine for producing and/or refining the fibrous material web so that the material web is guided into a catch device or trap. In the machine, the fibrous material web runs over heated drying cylinders and guidance rolls in the drying section and is guided at least predominately by at least one drying wire.

2. Discussion of Background Information

When a paper machine is started up, the paper web is transferred in sections, i.e., after reaching a subsequent section, the paper web is guided into a catch device or trap in the form of a vat. In this vat, the paper web is redissolved and is readmitted to the production process.

For this purpose, the paper web should be separated from the drying wire in the drying section and travel on the drying cylinder up to a doctor. However, it may occur here that, at the end of the respective transfer section, the paper web does not travel into the vat, but rather continues to travel with the drying wire in an uncontrolled manner. This usually makes any further transfer impossible and can even cause damage to subsequent units.

During normal operation, good adhesion of the fibrous material web to the drying wire is desired for secure guidance of the fibrous material web, e.g., particularly at high speeds. Furthermore, this is further supported by additional devices in the form of suction devices or air guidance devices.

SUMMARY OF THE INVENTION

The present invention provides secure guidance of the fibrous material web through the drying section in an operating state and ensures a controlled removal of the fibrous material web at the end of a transfer section during a transfer state.

The present invention includes a device that is provided with at least one controllable separating device, which at least reduces the adhesion forces between the fibrous material web and the drying wire.

Here, the separating device or devices are only to be used in the case of a transfer and/or a tear in the fibrous material web. In this way, good and secure guidance of the fibrous material web on the drying wire during normal operation is not impaired.

Experiments have shown that at least one separating device should be used for transferring the fibrous material web in the region of the drying section in which the fibrous material web has a dry content of less than about 43%. In this region, the moist fibrous material web tends to adhere more strongly to the drying wire than to the smooth drying cylinder. Therefore, it is advantageous for at least one separating device to be used after the transfer region between a preceding pressing section for dewatering the fibrous material web and the drying section. The direct transfer of the fibrous material web from the last pressing nip of the pressing section into the first drying group of the drying section makes the transfer process not only simpler, but also faster overall because, up to now, the fibrous material web was always removed between the pressing section and the drying section.

Accordingly, at least one drying cylinder in the initial region of the drying section, preferably of the first drying group of the drying section, is provided with at least one separating device. Because of the stretching of the moist fibrous material web, the first drying group should be as short as possible, i.e., the first drying group should have a maximum of three, preferably two, and in particular only one, drying cylinder(s).

With respect to the arrangement of the separating device, there are various possibilities, with it being advantageous, however, to arrange several separating device in the region of one or more drying cylinders. The separating device can be arranged in the wrapping region of a drying cylinder and/or shortly before it and/or after the wrapping region of a drying cylinder. Here, the separating devices, if they are on the side of the drying wire opposite the fibrous material web, can be embodied as air nozzles that direct pressurized air through the drying wire onto the fibrous material web, or as an air guidance element, preferably in the form of a flexible blade running crosswise to the fibrous material web, which partially dams the air border layer carried along by the drying wire and presses it towards the fibrous material web through the drying wire. As a result, in the transfer state, the fibrous material web should continue to travel over the drying cylinder after the removal of the drying wire and should be removed and guided into the intercepting device by a doctor placed against the drying cylinder.

Here, the one or more separation devices can also be part of an air guidance device, which is arranged in the region between the drying cylinder and the guidance roll and which guarantees the secure guidance of the fibrous material web on the drying wire under normal operating conditions.

If the separation devices are arranged on the side of the drying wire opposite the fibrous material web, preferably in the region of a guidance roll, a further possibility results from the fact that the separating device is embodied as a pressure nozzle that directs a pressurized stream of liquid or gas towards the drying wire for the purpose of separating the fibrous material web and, thus, guides the fibrous material web towards the intercepting device.

The present invention is directed to a device for removing a fibrous material web from a drying section of a machine for producing and/or refining the fibrous material web and into a catch device. The drying section includes heated drying cylinders, guidance rolls, and at least one drying wire arranged such that the fibrous material web is guided through the drying section over the heated drying cylinders and the guidance rolls at least predominately by the at least one drying wire. The device includes at least one controllable separating device arranged to at least reduce an adhesion force between the fibrous material web and the at least one drying wire.

In accordance with a feature of the instant invention, the fibrous material web can include one of a cardboard, paper, and tissue web.

According to another feature of the invention, the at least one separating device may be arranged at least one of in a wrapping region of a drying cylinder and shortly before it.

Further, the at least one separating device may be arranged after a wrapping region of a drying cylinder. The at least one separating device can be positioned on a side of the at least one drying wire arranged to carry the fibrous material web. The at least one separating device may be arranged in a region of a guidance roll. Still further, the at least one separating device may include a pressure nozzle arranged to direct a stream of pressurized gas or liquid toward the at least one drying wire, such that the fibrous material web is separated from the at least one drying wire.

According to still another feature of the present invention, the separating device can be arranged on a side of the at least one drying wire opposite the fibrous material web.

The separating device may be embodied as an air nozzle arranged to direct pressurized air through the at least one drying wire toward the fibrous material web.

Moreover, the separating device may be embodied as an air guidance element arranged to at least partially interfere with an air border layer carried along by the at least one drying wire and to press the interfered with part of the air border layer through the at least one drying wire toward the fibrous material web. The air guidance element can include a flexible blade running crosswise to the fibrous material web.

A doctor may be arranged to grip onto the drying cylinder after the wrapping region of the fibrous material web, such that the fibrous material web can be removed.

An air guidance device may include the at least one separation device, which is located in a region between the drying cylinder and the guidance roll and is arranged to provide a secure guidance of the fibrous material web on the at least one drying wire under normal operating conditions.

According to a further feature of the invention, the at least one separating device can include a plurality of separating devices arranged in a region of the drying cylinder.

The drying section may include an initial region including at least one heated drying cylinder. The at least one separating device can be associated with the at least one drying cylinder of the initial region. Further, the initial region can include a maximum of three drying cylinders, at least two drying cylinders, and preferably, only one drying cylinder.

The present invention is directed to a process for removing a fibrous material web from a drying section of a machine for producing and/or refining the fibrous web and into a catch device. The drying section includes heated drying cylinders, guidance rolls, at least one drying wire, and at least one separating device. The process includes guiding the fibrous material web through the drying section over the heated drying cylinders and the guidance rolls at least predominately by the at least one drying wire, and, in an event of at least one of a transfer and a tear in the fibrous material web, actuating the at least one separating device.

According to a feature of the instant invention, the at least one separating device can be used for transferring the fibrous material web in a region of the drying section in which the fibrous material web has a dry content of less than about 43%.

The at least one separating device may be arranged after a transfer region between a previous pressing section for dewatering the fibrous material web and the drying section.

The separating device can include an air nozzle arranged on a side of the at least one drying wire opposite the fibrous material web, and the process may further include directing pressurized air from the air nozzle through the at least one drying wire toward the fibrous material web.

Moreover, the separating device may include an air guidance element, and the process can include at least partially interfering with an air border layer carried along by the at least one drying wire and pressing the interfered with part of the air border layer through the at least one drying wire toward the fibrous material web. The air guidance element may include a flexible blade extending crosswise to the fibrous material web.

The drying section can further include a doctor positioned against a surface of the drying cylinder after the wrapping region of the fibrous material web, and the process can further include removing the fibrous material web from the surface of the drying cylinder with the doctor.

The drying section can include an air guidance device which includes the at least one separation device, the air guidance device being located in a region between the drying cylinder and the guidance roll, and the process may also include securely guiding, via the air guidance device, the fibrous material web on the at least one drying wire under normal operating conditions.

The at least one separating device may include a pressure nozzle positioned on a side of the at least one drying wire arranged to carry the fibrous material web and in a region of a guidance roll, and the process may include directing a stream of pressurized gas or liquid from the pressure nozzle toward the fibrous material web carrying side of the at least one drying wire to separate the fibrous material web from the at least one drying wire.

The present invention is directed to an apparatus for producing and/or refining a fibrous material web including a catch device arranged to receive a portion of the web, whereby the portion of the web is readmitted to a production process, a drying section including a least one drying group, where the at least one drying group includes at least one heated drying cylinder, guidance rolls, at least one drying wire arranged to at least predominantly guide the fibrous material web through the drying section, and at least one controllable separating device arranged to at least reduce an adhesion force between the fibrous material web and the at least one drying wire.

In accordance with a feature of the instant invention, the fibrous material web may include one of a cardboard, paper, and tissue web.

The separating device may include an air deflection element arranged to deflect air entrained by movement of the at least one drying wire through the at least one drying wire, thereby reducing an adhesion force between the at least one drying wire and the fibrous material web.

Moreover, the separating device may include an air jet nozzle arranged to direct air through the at least one drying wire, thereby reducing an adhesion force between the at least one drying wire and the fibrous material web. An air guidance device can be arranged to guide the web between the at least one drying cylinder and an adjacent guidance roll during normal operation, such that the air guidance device includes the at least one separating device. The at least one separating device can be activated and the air guidance device can be deactivated in an event of at least one of a transfer and a tear of the fibrous material web.

According to another feature of the invention, the at least one separating device may include a pressure nozzle arranged to direct a stream of pressurized gas or liquid toward a fibrous material web carrying surface of said at least one drying wire.

In accordance with yet another feature of the present invention, the at least one separating device can be positioned on a side of said at least one drying wire arranged to carry the fibrous material web. The at least one separating device may be arranged in a region of a guidance roll. Further, the at least one separating device can include a pressure nozzle arranged to direct a stream of pressurized gas or liquid toward said at least one drying wire, whereby the fibrous material web is separated from said at least one drying wire.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

The FIGURE schematically illustrates a transfer of the fibrous material web from a pressing section to a drying section with a controllable removal of the fibrous material web after a first drying cylinder into a catch device.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the pressing section, fibrous material web 1, along with pressing felts 13 arranged to travel on each side of fibrous web 1, is guided through at least one pressing nip formed by two pressing rolls 12 for the purpose of dewatering. Subsequently, a transfer of fibrous material web 1 occurs from the lower pressing felt 13 of a pressing section to a drying wire 5 of a first drying group. The transfer can be supported by a suctioned guidance roll wrapped by drying wire 5.

A drying section can include several drying groups such that fibrous material web 1 alternately travels over heated drying cylinders 3 and suctioned guidance rolls 4 and is guided by drying wire 5 of a respective drying group. Here, drying cylinders 3 are arranged in an upper row and guidance rolls 4 are arranged in a lower row, with drying wire 5 pressing fibrous material web 1 against heated drying cylinders 3, which leads to a heating of fibrous material web 1 and, thus, to evaporation of the moisture of fibrous material web 1.

Suctioned guidance rolls 4 have a perforated roll jacket whose inner chamber can be connected to a vacuum source directly or, as shown here, indirectly by way of an air guidance device 9 arranged in a region of guidance roll 4 which is not wrapped, i.e., between neighboring drying cylinders 3. This known air guidance device 9 should ensure guidance of fibrous material web 1 on drying wire 5 during normal operation in the region between drying cylinder 3 and guidance roll 4, which generally occurs by a vacuum producer on the side of drying wire 5 facing away from fibrous material web 1.

The first drying group can include, e.g., two drying cylinders 3, and preferably only two drying cylinders. In this regard, it is noted that, at a beginning of the drying section, it is necessary to take into account relatively strong stretching of fibrous material web 1 and the dangers of web tearing or fold formation associated therewith. A short drying group allows for quick build-up of a tension between the drying groups and thus a stretching compensation.

When the paper machine is started up, fibrous material web 1 is directly transferred into the first drying group as strips or in its full width after having reached the last pressing nip. This simplifies and speeds up the transfer procedure. However, after first drying cylinder 3, a removal of the tail of fibrous material web 1 into catch device or trap 2 must be ensured.

Because fibrous material web 1, due to its dry content of less than about 40%, has the tendency to continue to travel with drying wire 5, separating device 6 is used in the region of first drying cylinder 3.

For this purpose, shortly before the wrapped region of drying cylinder 3, an air guidance element 8, e.g., in the form of a flexible blade extending crosswise to a travel direction of fibrous material web 1 and arranged on a side of drying wire 5 opposite fibrous material web 1, is used as separating device 6. According to this arrangement, an air border layer carried by drying wire 5 is partially dammed and pressed through drying wire 5 in a direction toward fibrous material web 1. As a result, the adhesion of fibrous material web 1 to drying wire 5 is to be loosened.

Shortly after the transfer region of drying cylinder 3, the separation of fibrous material web 1 from drying wire 5 occurs, e.g., via a separating device 6' in the form of an air nozzle 7 that directs air through drying wire 5 towards fibrous material web 1. Fibrous material web 1 then travels, at the most, up to a doctor 11 acting against a surface of drying cylinder 3, where the removed fibrous material web 1 falls toward catch device 2.

During a transfer state, air guidance device 9, which is positioned between adjacent drying cylinders 3, should not be active. Moreover, in order to simplify the construction, separating device 6' in the form of air nozzle 7 can be integrated into air guidance device 9.

Moreover, alternately and/or additionally, separating device 6" in the form of a pressure nozzle 10 can be positioned in a region of guidance roll 4 adjacent a side of drying wire 5 which carries fibrous material web 1 so that pressure nozzle 10 is arranged to direct pressurized air toward drying wire 5 for the purpose of separating fibrous material web 1 from drying wire 5. The removal of fibrous material web 1 into catch device 2 is the goal here as well.

The arrangement can also be used in the case of a tear in fibrous material web 1 in this region. A continuation of the transfer procedure is possible by deactivation of the separating devices 6, 6', and/or 6" and, thereby, a continued guidance of the previously stricken off fibrous material web 1 on drying wire 5. For this purpose, the corresponding air guidance device 9 can also be reactivated.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device for removing a fibrous material web from a drying section of a machine for producing and/or refining the fibrous material web and into a catch device, the drying section including heated drying cylinders, guidance rolls, and at least one drying wire arranged such that the fibrous material web is guided through the drying section over the heated drying cylinders and the guidance rolls at least predominately by the at least one drying wire, said device comprising:

at least one controllable separating device arranged to at least reduce an adhesion force between the fibrous material web and said at least one drying wire.

2. The device in accordance with claim 1, wherein the fibrous material web comprises one of a cardboard, paper, and tissue web.

3. The device in accordance with claim 1, wherein said at least one separating device is arranged at least one of in a wrapping region of a drying cylinder and shortly before it.

4. The device in accordance with claim 1, wherein said at least one separating device is arranged after a wrapping region of a drying cylinder.

5. The device in accordance with claim 4, wherein said at least one separating device is positioned on a side of said at least one drying wire arranged to carry the fibrous material web.

6. The device in accordance with claim 5, wherein said at least one separating device is arranged in a region of a guidance roll.

7. The device in accordance with claim 5, wherein said at least one separating device comprises a pressure nozzle arranged to direct a stream of pressurized gas or liquid toward said at least one drying wire, whereby the fibrous material web is separated from said at least one drying wire.

8. The device in accordance with claim 1, wherein said separating device is arranged on a side of said at least one drying wire opposite the fibrous material web.

9. The device in accordance with claim 1, wherein said separating device is embodied as an air nozzle arranged to direct pressurized air through said at least one drying wire toward the fibrous material web.

10. The device in accordance with claim 1, wherein said separating device is embodied as an air guidance element arranged to at least partially interfere with an air border layer carried along by said at least one drying wire and to press the interfered with part of the air border layer through said at least one drying wire toward the fibrous material web.

11. The device in accordance with claim 10, wherein said air guidance element comprises a flexible blade running crosswise to the fibrous material web.

12. The device in accordance with claim 1, further comprising a doctor arranged to grip onto said drying cylinder after the wrapping region of the fibrous material web, whereby the fibrous material web is removed.

13. The device in accordance with claim 1, wherein an air guidance device comprising said at least one separation device is located in a region between said drying cylinder and said guidance roll and is arranged to provide a secure guidance of the fibrous material web on said at least one drying wire under normal operating conditions.

14. The device in accordance with claim 1, wherein said at least one separating device comprises a plurality of separating devices arranged in a region of said drying cylinder.

15. The device in accordance with claim 1, wherein said drying section comprises an initial region including at least one heated drying cylinder.

16. The device in accordance with claim 15, wherein said at least one separating device is associated with said at least one drying cylinder of said initial region.

17. The device in accordance with claim 15, wherein said initial region comprises a maximum of three drying cylinders.

18. The device in accordance with claim 15, wherein said initial region comprises at least two drying cylinders.

19. The device in accordance with claim 15, wherein said initial region comprises only one drying cylinder.

20. A process for removing a fibrous material web from a drying section of a machine for producing and/or refining the fibrous web and into a catch device, the drying section including heated drying cylinders, guidance rolls, at least one drying wire, and at least one separating device, said process comprising:

guiding the fibrous material web through the drying section over the heated drying cylinders and the guidance rolls at least predominately by the at least one drying wire; and in an event of at least one of a transfer and a tear in the fibrous material web, actuating the at least one separating device.

21. The process in accordance with claim 20, wherein the at least one separating device is used for transferring the fibrous material web in a region of the drying section in which the fibrous material web has a dry content of less than about 43%.

22. The process in accordance with claim 20, wherein the at least one separating device is arranged after a transfer region between a previous pressing section for dewatering the fibrous material web and the drying section.

23. The process in accordance with claim 20, wherein said separating device comprises an air nozzle arranged on a side of the at least one drying wire opposite the fibrous material web, and said process further comprises:

directing pressurized air from the air nozzle through the at least one drying wire toward the fibrous material web.

24. The process in accordance with claim 20, wherein said separating device comprises an air guidance element, and said process further comprises:

at least partially interfering with an air border layer carried along by the at least one drying wire and pressing the interfered with part of the air border layer through the at least one drying wire toward the fibrous material web.

25. The process in accordance with claim 24, wherein the air guidance element comprises a flexible blade extending crosswise to the fibrous material web.

26. The process in accordance with claim 20, wherein the drying section further includes a doctor positioned against a surface of the drying cylinder after the wrapping region of the fibrous material web, and said process further comprises:

removing the fibrous material web from the surface of the drying cylinder with the doctor.

27. The process in accordance with claim 20, wherein the drying section further includes an air guidance device which includes the at least one separation device, the air guidance device being located in a region between the drying cylinder and the guidance roll, and said process further comprises:

securely guiding, via the air guidance device, the fibrous material web on the at least one drying wire under normal operating conditions.

28. The process in accordance with claim 20, wherein the at least one separating device includes a pressure nozzle positioned on a side of said at least one drying wire arranged to carry the fibrous material web and in a region of a guidance roll, and said process further comprises:

directing a stream of pressurized gas or liquid from the pressure nozzle toward the fibrous material web carrying side of the at least one drying wire to separate the fibrous material web from the at least one drying wire.

29. An apparatus for producing and/or refining a fibrous material web comprising:

a catch device arranged to receive a portion of the web, whereby the portion of the web is readmitted to a production process;

a drying section including a least one drying group;

said at least one drying group comprising at least one heated drying cylinder;

guidance rolls;

at least one drying wire arranged to at least predominantly guide the fibrous material web through said drying section; and at least one controllable separating device arranged to at least reduce an adhesion force between the fibrous material web and said at least one drying wire.

30. The apparatus in accordance with claim 29, wherein the fibrous material web comprises one of a cardboard, paper, and tissue web.

31. The apparatus in accordance with claim 29, wherein said separating device comprises an air deflection element arranged to deflect air entrained by movement of said at least one drying wire through said at least one drying wire, thereby reducing an adhesion force between said at least one drying wire and the fibrous material web.

32. The apparatus in accordance with claim 29, wherein said separating device comprises an air jet nozzle arranged to direct air through said at least one drying wire, thereby reducing an adhesion force between said at least one drying wire and the fibrous material web.

33. The apparatus in accordance with claim 32, further comprising an air guidance device arranged to guide the web between said at least one drying cylinder and an adjacent guidance roll during normal operation, wherein said air guidance device comprises said at least one separating device.

34. The apparatus in accordance with claim 33, wherein said at least one separating device is activated and said air guidance device is deactivated in an event of at least one of a transfer and a tear of the fibrous material web.

35. The apparatus in accordance with claim 29, wherein said at least one separating device comprises a pressure nozzle arranged to direct a stream of pressurized gas or liquid toward a fibrous material web carrying surface of said at least one drying wire.

36. The device in accordance with claim 29, wherein said at least one separating device is positioned on a side of said at least one drying wire arranged to carry the fibrous material web.

37. The device in accordance with claim 36, wherein said at least one separating device is arranged in a region of a guidance roll.

38. The device in accordance with claim 36, wherein said at least one separating device comprises a pressure nozzle arranged to direct a stream of pressurized gas or liquid toward said at least one drying wire, whereby the fibrous material web is separated from said at least one drying wire.

* * * * *